US006488355B2

(12) United States Patent
Nakamura et al.

(10) Patent No.: US 6,488,355 B2
(45) Date of Patent: Dec. 3, 2002

(54) INK JET HEAD

(75) Inventors: Hirofumi Nakamura; Torahiko Kanda, both of Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/813,009

(22) Filed: Mar. 21, 2001

(65) Prior Publication Data

US 2002/0018095 A1 Feb. 14, 2002

(30) Foreign Application Priority Data

Mar. 21, 2000 (JP) ..... 2000-078876

(51) Int. Cl.[7] ..... B41J 2/15
(52) U.S. Cl. ..... 347/40; 347/12; 347/68
(58) Field of Search ..... 347/40, 12, 68, 347/70, 71

(56) References Cited

U.S. PATENT DOCUMENTS 5,455,615 A 10/1995 Burr et al. ..... 347/92
5,757,400 A 5/1998 Hoisington ..... 347/40
6,220,698 B1 * 4/2001 Katakura ..... 347/68

FOREIGN PATENT DOCUMENTS

EP 0 869 001 A2 10/1998
EP 0 950 525 A2 10/1999
JP 4-148936 5/1992

* cited by examiner

*Primary Examiner*—Lamson Nguyen
(74) *Attorney, Agent, or Firm*—McGinn & Gibb, PLLC

(57) ABSTRACT

In an ink jet head, in order to make the occupying area of a chamber associated to each nozzle as small as possible, while maintaining a discharge ink drop volume, and on the other hand, to locate a number of nozzles with a high density, the plan view shape of a pressure plate provided to each chamber is so configured to fulfill the relation of 1:≦A≦2, where "A" is the ratio of an circumscribed circle diameter of the plan view shape of the pressure plate to an inscribed circle diameter of the plan view shape of the pressure plate. For example, the pressure plate is formed to have the plan view shape of a substantial square or a substantial rhombus. The chambers having such a feature are located in the form of a matrix. Thus, a stably driven, highly reliable ink jet head can be realized.

20 Claims, 7 Drawing Sheets

INK JET HEAD

BACKGROUND OF THE INVENTION

The present invention relates to an ink jet head having a number of nozzles for discharging an ink drop, located with a high density. More specifically, the present invention relates to an ink jet head incorporated in an ink jet printing machine and configured to shoot an ink drop to a recording medium to produce a printed image recording, the ink jet head including a plurality of nozzles, a plurality of chambers located for the plurality of nozzles, respectively, a pressure plate forming one plane of each chamber, and an actuator provided for each pressure plate, so that when the actuator is driven, a corresponding pressure plate is deformed to compress an ink in a corresponding chamber so as to cause an ink drop to be discharged from a corresponding nozzle.

Now, the prior art of the ink jet head will be described with reference to FIG. 11, which illustrates one example of the prior art ink jet head disclosed in Japanese Patent Application Pre-examination Publication No. JP-04-148936-A. This prior art ink jet head includes a number of nozzles 101 arranged in a single array to depict a straight line, a number of chambers 102, each having an elongated plan view shape, staggered at opposite sides of the nozzle array, with one end of each chamber being located on a corresponding nozzle, and the other end of each chamber having a supplying port 103.

Furthermore, the ink jet head has an ink pool 104 in common to all the chambers, at a layer different from the layer where the chambers are formed. The ink pool 104 is connected to each chamber 102 through the associated supplying port 103. In addition, an actuator (not shown) is mounted on a pressure plate (not shown) forming one plane of each chamber. The following description will be made on the premise that the actuator is constituted of a piezoelectric actuator.

The ink jet head operates as follows: When the actuator is driven, the pressure plate is flexed to reduce the volume of the chamber 102, with the result that the ink in the chamber is compressed so that an ink drop is discharged through the nozzle 101. After the ink drop is discharged, when the pressure plate restores its original form, the ink is re-charged into the chamber through the supplying port from the ink pool 104

The above mentioned prior art ink jet head is advantageous since it is possible to realize a high density location of nozzles by reducing the pitch of the nozzles in the nozzle array and by locating a number of chambers having a narrow witch corresponding to the reduced pitch.

However, since the width of the chamber must be inevitably reduced with increase of the nozzle density, the pressure plate assumes the shape difficult to flex, with the result that it is no longer possible to ensure a necessary amount of volume change in the chamber. For reference, it is said that the amount of volume change of at least 30 pl (picoliter) is required to realize a high speed printing. If only a too small ink drop is discharged, the printing speed unavoidably becomes low.

In this connection, it may be considered to enlarge the longitudinal length of the chamber so as to increase the amount of volume change in the chamber. In this case, however, the occupying area of the chamber becomes large, with the result that the areal density of the nozzles cannot be elevated.

BRIEF SUMMARY OF THE INVENTION

Accordingly, it is an object of the present invention to provide an ink jet head which has overcome the above mentioned problems of the prior art.

Another object of the present invention is to provide an ink jet head including a chamber having a pressure plate of the shape easy to flex, thereby to be able to reduce the occupying area of the chamber while maintaining a necessary volume of discharged ink drop, so as to realize a high density of nozzle location.

Still another object of the present invention is to provide a stably driven, highly reliable, ink jet head capable of maintaining a necessary volume of discharged ink drop even if the nozzles are located with a high density.

A further object of the present invention is to provide an ink jet head which can be manufactured with a simplified fabricating process and with a high working precision.

The above and other objects of the present invention are achieved in accordance with the present invention by an ink jet head comprising:

- a plurality of nozzles arranged to constitute a matrix having a plurality of rows inclined at a constant angle to a head main scan direction and a plurality of columns orthogonal to the head main scan direction;
- a plurality of chambers provided for the plurality of nozzles, respectively;
- a pressure plate formed to constitute one plane of each of the plurality of chambers;
- an actuator provided to each pressure plate, for deforming the pressure plate to compress an ink within a corresponding chamber;
- a plurality of ink pool branches provided along the plurality of rows or the plurality of columns, for supplying the ink to the plurality of chambers; and
- a main ink pool connected to the plurality of ink pool branches, wherein the pressure plate has a plan view shape fulfilling the relation of $1 \leqq A \leqq 2$ where "A" is the ratio of an circumscribed circle diameter of the plan view shape of the pressure plate to an inscribed circle diameter of the plan view shape of the pressure plate.

For example, the pressure plate has the plan view shape of a substantial square, or alternatively the plan view shape of a substantial rhombus having a pair of sides in parallel to the plurality of rows and another pair of sides in parallel to the plurality of columns.

With this arrangement, the pressure plate has the shape easy to be flexed by the actuator when the actuator is driven. Therefore, even if the occupying area of the chamber is reduced, a highly efficient chamber can be realized which can maintain a necessary amount of volume change caused when the actuator is driven. Accordingly, a number of nozzles can be located with a high density without reducing the volume of the discharged ink drop.

When the pressure plate has the plan view shape of a substantial rhombus having a pair of sides in parallel to the plurality of rows and another pair of sides in parallel to the plurality of columns, the actuator preferably has a plan view shape of a substantial rhombus having a pair of sides in parallel to the plurality of rows and another pair of sides in parallel to the plurality of columns.

With this arrangement, the actuators can be formed in bundle by dicing an actuator material sheet in units of row and in units of column. Therefore, the fabricating process can be simplified, and it is possible to elevate the precision in the size and in the position of the actuator.

In addition, each of the plurality of chambers preferably has an ink supply port to form an ink flow in the direction of a long diagonal of the substantial rhombus.

With this arrangement, an ink flow within the chamber is smoothed, so that it is possible to prevent a bubble from staying, thereby to elevate reliability of the ink jet.

When the inclination of each row to the head main scan direction is expressed by "θ" and the interval of the plurality of nozzles in a direction orthogonal to the head main scan direction is expressed by "d" (mm), "θ" and "d" are preferred to have the relation of $0<\tan\theta\leqq 5d$.

With this arrangement, the width of each chamber in the main scan direction can have the size of not less than about 0.2 mm, so that it is possible to obtain the chamber size capable of generating the amount of volume change sufficient to discharge a desired volume of ink drop.

Furthermore, when the number of the nozzles included in each row is expressed by "n", "n" and "d" are preferred to have the relation of $n\times d\geqq 0.2$.

Also with this arrangement, the width of each chamber in the direction orthogonal to the main scan direction can have the size of not less than about 0.2 mm, so that it is possible to obtain the chamber size capable of generating the amount of volume change sufficient to discharge a desired volume of ink drop.

Furthermore, "n" and "θ" preferably have the relation of $0.5\leqq n\times\tan\theta\leqq 2$.

With this arrangement, each chamber can have the head main scan direction width which is not greatly different from the width in the direction orthogonal to the head main scan direction. Therefore, according to this layout, the chambers can be located with a high density in the form of a matrix with no substantial wasteful space. For example, in the case of $n\times\tan\theta<1$, each chamber can have the head main scan direction width larger than the width in the direction orthogonal to the head main scan direction. On the other hand, in the case of $n\times\tan\theta>1$, each chamber can have the head main scan direction width smaller than the width in the direction orthogonal to the head main scan direction. Accordingly, when each chamber assumes a plan view shape of the substantial square or the substantial rhombus, an empty space can be effectively used as a space for the ink pool branches, so that the chamber and the branches can be located with a high density.

Further, it is preferred that the main ink pool has the cross-sectional area larger than the cross-sectional area of the ink pool branch.

With this arrangement, even if all the ink flows flowing through all the ink pool branches are caused to flow through the main ink pool, a stably stream can be obtained. In addition, since a flow resistance is small, the supply amount of ink per a unit time can be enlarged, and therefore, a discharging frequency can be increased. Furthermore, a difference in the ink supplying amount between the ink pool branches can be reduced so that the variation in the discharge characteristics between the nozzles can be suppressed.

Moreover, it is also preferred that the main ink pool and/or each ink pool branch has the cross-sectional area gradually decreasing toward the downstream end.

In the main ink pool, the ink flow rate drops to toward the downstream end, since the ink is supplied to the associated ink pool branches. In addition, in each ink pool branch, the ink flow rate also drops to toward the downstream end, since the ink is supplied to the associated chambers. With this arrangement, however, it is possible to prevent the flow velocity from dropping. Accordingly, the ink can be stably supplied to the chambers positioned at the downstream side of the ink flow, so that the variation in the discharge characteristics between the nozzles can be suppressed. Furthermore, it is possible to prevent stay of a bubble, which would have been caused because of the drop of the flow velocity, thereby to elevate reliability of the ink jet.

The above and other objects, features and advantages of the present invention will be apparent from the following description of preferred embodiments of the invention with reference to the accompanying drawings.

DETAILED DESCRIPTION OF THE INVENTION

Before explaining embodiments of the ink jet head in accordance with the present invention, explanation will be made on our research for seeking the shape of an highly efficient chamber having a small occupying area and a large amount of volume change when it is driven.

Figure 1A:
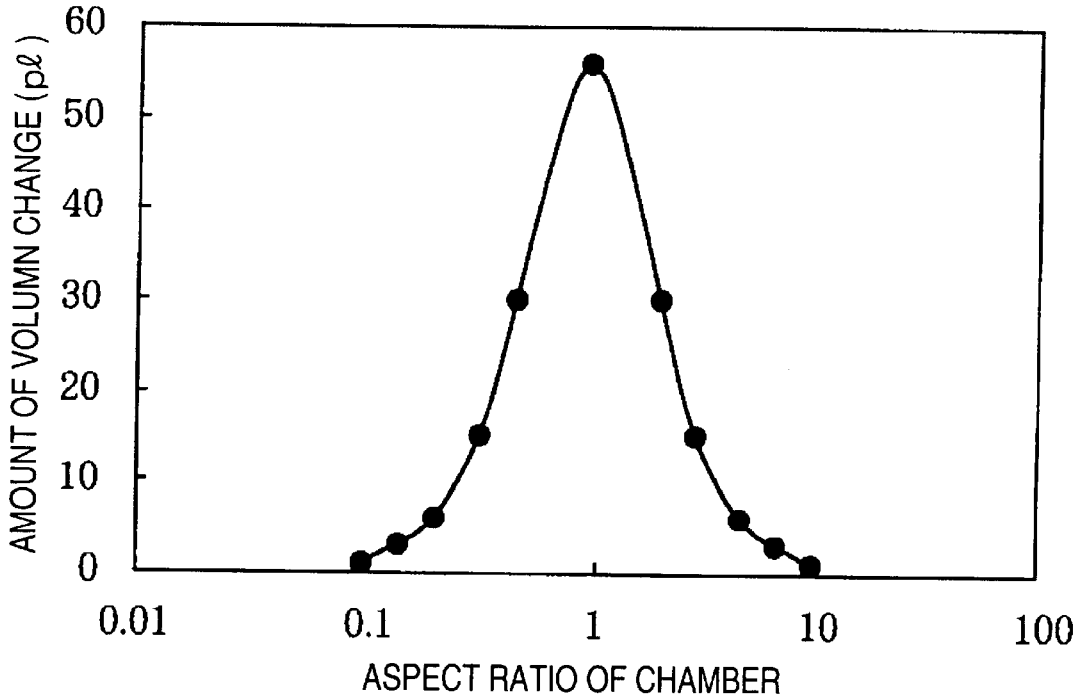
FIG. 1A is a graph illustrating the relation between the amount of volume change of a chamber having the plan view shape of a quadrilateral and the aspect ratio of the plan view shape of the chamber.

Referring to FIG. 1A, there is shown a graph illustrating, in chambers having the plan view shape of various quadrilaterals having the same area, the relation between the aspect ratio of each plan view shape and the amount of volume change of the chamber when the same pressure is applied to a pressure plate provided in the plane having the plan view shape concerned. Here, the amount of volume change in the chamber corresponds to the volume of a discharged ink drop. The relation shown in the graph was obtained by a numerical analysis executed under the condition that the pressure plate plane of each chamber is 0.608 millimeter squared, the pressure plate is formed of a Ni (nickel) sheet having the elastic modulus of 200 GPa and a thickness of 20 μm, and the applied pressure is 0.1 MPa.

This result shows that if the aspect ratio of the plan view shape (pressure plate plane) of the chamber is closer to "1", namely, the plan view shape is nearer to a square, a larger amount of volume change can be obtained. In other words, if the chamber is formed to have the plan view shape nearer to the square, a large amount of volume change can be obtained with a small occupying area.

Incidentally, the above research was conducted for the chamber having the plan view shape of a quadrilateral. However, a similar effect can be obtained in the chamber having the plan view shape of a polygon other than the quadrilateral or of an ellipse (including a circle). In this case, specifically, if a ratio of a maximum width to a minimum width of the polygon or the ellipse is closer to "1", a large amount of volume change can be obtained.

Figure 1B:
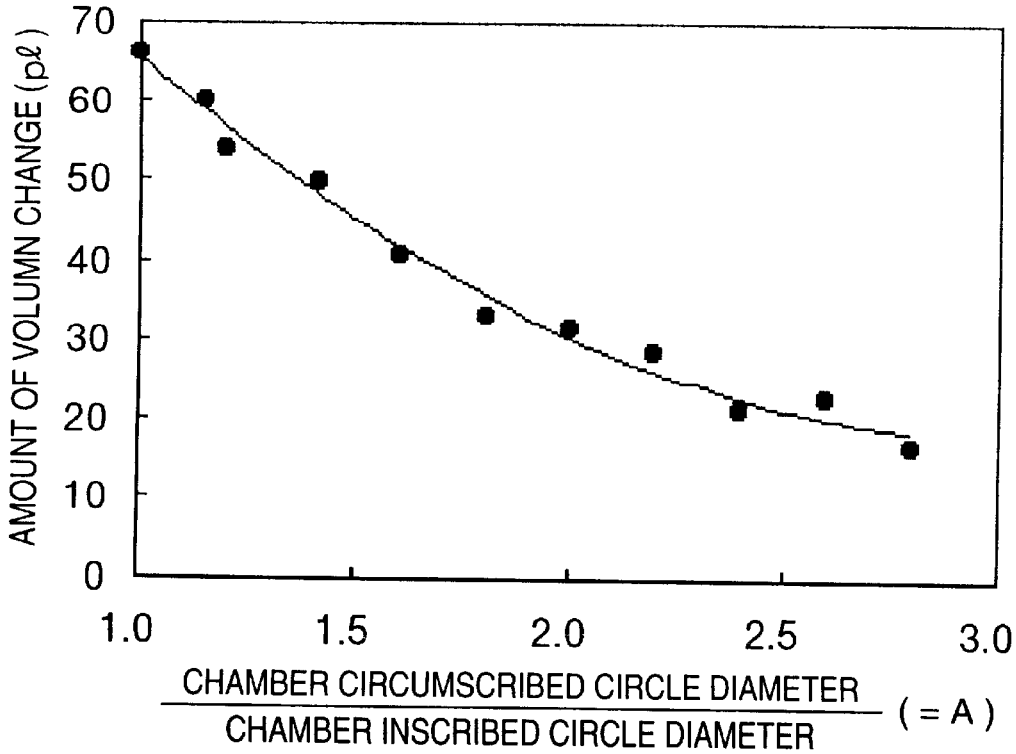
FIG. 1B is a graph illustrating the relation between the amount of volume change of a chamber having various plan view shapes and the ratio of an circumscribed circle diameter of the plan view shape of the chamber to an inscribed circle diameter of the plan view shape of the chamber.

Therefore, a further research was conducted for the plan view shape of the chamber, namely, the shape of the pressure plate plane of the chamber. Various plan view shapes can be considered by classifying on the basis of the number of angles. For example, a triangle includes an equilateral triangle, a right-angle triangle, an isosceles triangle, etc. A quadrilateral includes a square, a rectangle, a trapezoid, a rhombus, etc. Referring to FIG. 1B, there is shown the result obtained by a numerical analysis of the amount of volume change in the chamber when a constant pressure is applied to pressure plate planes of different plan view shapes including the triangle, the quadrilateral, the hexagon, the circle, etc., having the same area. The axis of abscissas indicates the ratio of an circumscribed circle diameter of the plan view shape of the chamber (namely, the shape of the pressure plate plane of the chamber) to an inscribed circle diameter of the plan view shape of the chamber (this ratio can be called a chamber shape parameter "A" in this specification), and the axis of ordinates indicates the amount of volume change in the chamber. Here, the parameter "A" has a minimum value depending upon the number of angles of the plan view shape of the chamber (namely, the shape of the pressure plate plane of the chamber). The triangle has the minimum parameter "A" of "2" in the case of the equilateral triangle. The quadrilateral has the minimum parameter "A" of "√2" in the case of the square. The hexagon has the minimum parameter "A" of "2/√3" in the case of the regular hexagon. The ellipse has the minimum parameter "A" of "1" in the case of the circle. For reference, the analysis condition was that the pressure plate plane of each chamber is 0.375 millimeter squared, the pressure plate is formed of a Ni (nickel) sheet having the elastic modulus of 200 GPa and a thickness of 15 μm, and the applied pressure is 0.1 MPa.

It would be apparent from the result shown in FIG. 1B that the relation between the parameter "A" and the amount of volume change in the chamber does not substantially depend upon the number of angles of the shape of the pressure plate plane of the chamber. Namely, if the area of the pressure plate plane is determined, the amount of volume change can be set from only the parameter "A". It would be also apparent from the result shown in FIG. 1B that in order to realize a target value of 30 picoliters or more, the parameter "A" is required to be not greater than "2". Incidentally, the minimum value of the parameter "A" is "1" obtained in the case of a circle.

Figure 3:
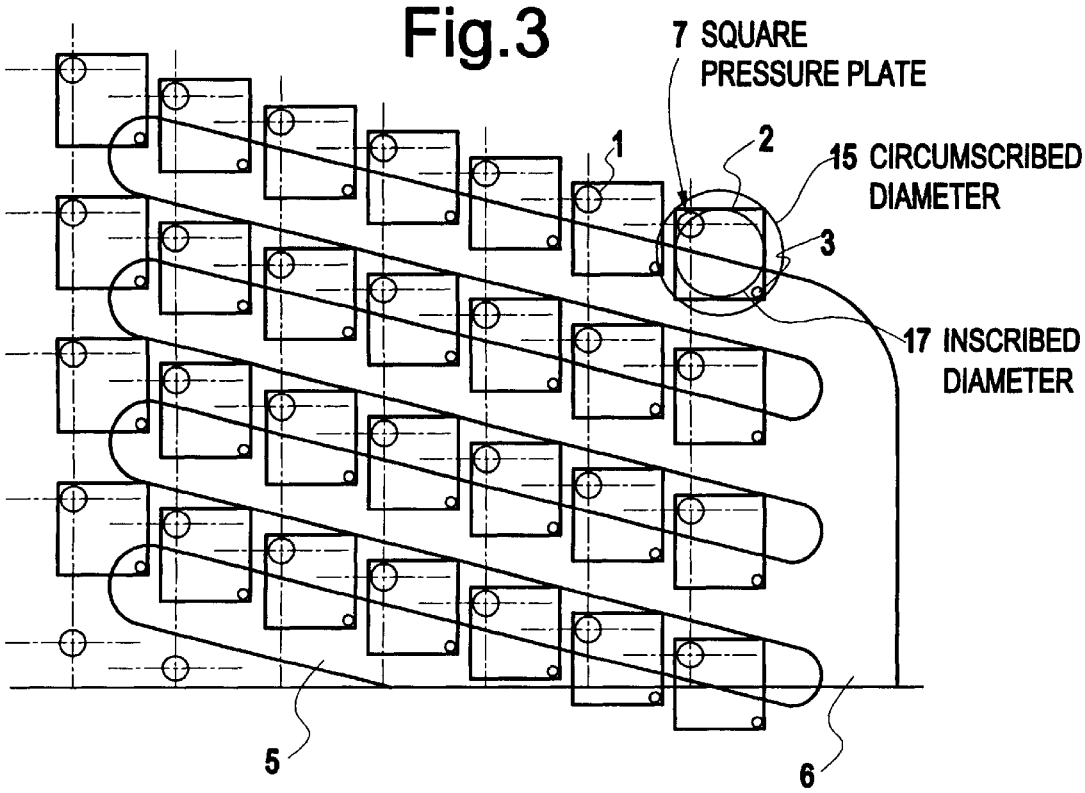
FIG. 3 is a diagrammatic enlarged, partial layout pattern of the first embodiment of the ink jet head in accordance with the present invention.

As indicated, pressure plates can have a variety of shapes with different A values. FIG. 3 illustrates a plan view of a normal square shaped pressure plate 7 with a circumscribed diameter 15 and an inscribed diameter 17 as discussed above and referred to in FIG. 1B.

As mentioned above, in the ink jet head in accordance with the present invention, the nozzles are located in the form of a matrix. In this case, the condition given to the chamber size when the chamber is located for the nozzle, is that the width in the head main scan direction is smaller than the nozzle pitch (=d/tan θ) in the head main scan direction and the width in the direction orthogonal to the head main scan direction is smaller than the nozzle row pitch (=n×d) in the direction orthogonal to the head main scan direction. Accordingly, the aspect ratio of the plan view shape of the chamber (the shape of the pressure plate plane of the chamber) is expressed by (n×tan θ). Therefore, a permissibly range of the aspect ratio of the plan view shape of the chamber can be expressed by (n×tan θ). If (n×tan θ) is not smaller than 0.5 (the head main scan direction width is longer than the width in the direction orthogonal to the head main scan direction) and is not greater than 2 (the with in the direction orthogonal to the head main scan direction is longer than the head main scan direction width), namely, if $0.5 \leqq n \times \tan\theta \leqq 2$ when the chambers fulfilling the condition of $1 \leqq A \leqq 2$ are located, the chambers can be laid out with a high density. In other words, if $0.5 \leqq n \times \tan\theta \leqq 2$, the chambers capable of realizing the discharge capability of 30 picoliters can be advantageously located with a high density.

Figure 10:
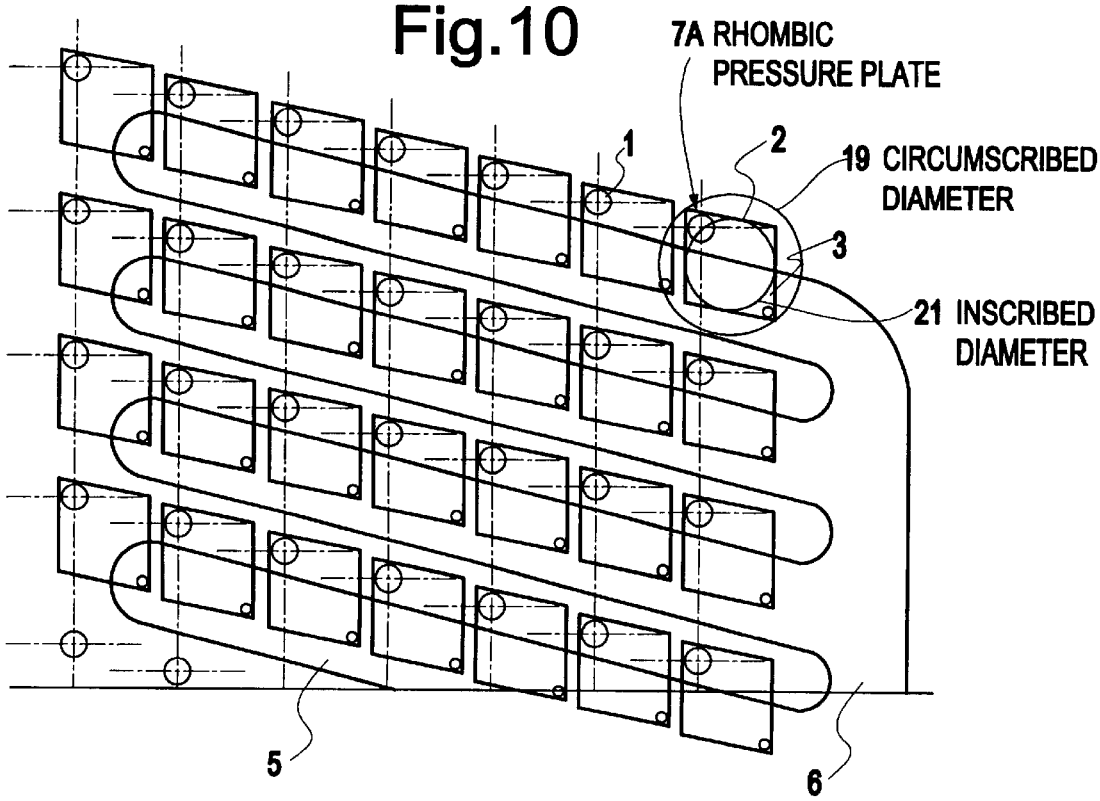
FIG. 10 is a diagrammatic enlarged, partial layout pattern of a second embodiment of the ink jet head in accordance with the present invention.
Figure 11:
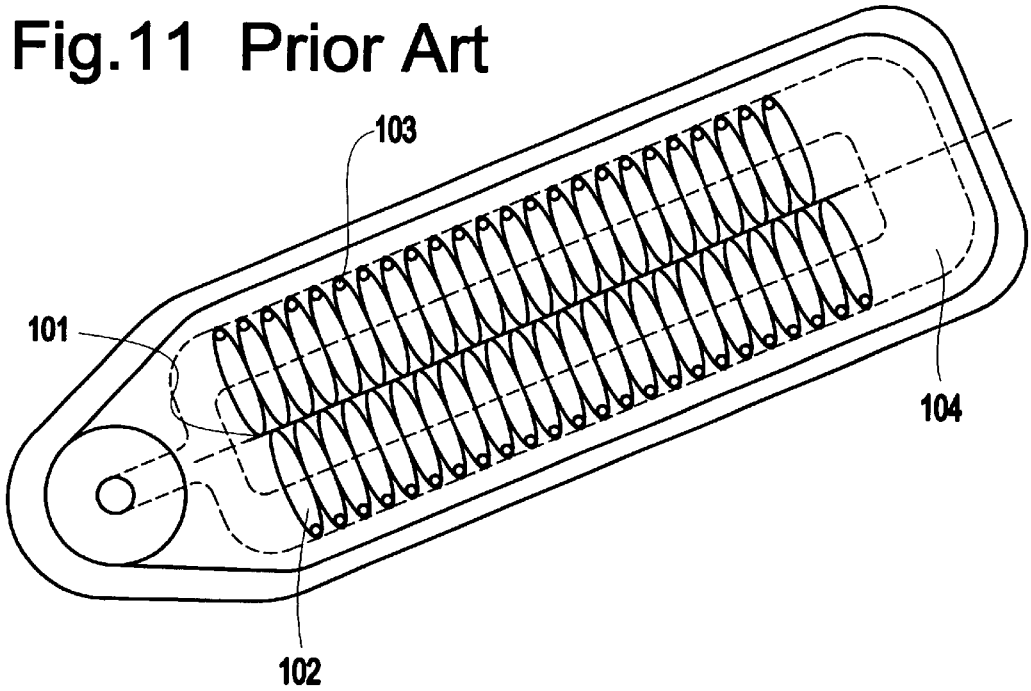
Fig.11 Prior Art
FIG. 11 is a diagrammatic layout pattern of the ink jet head in the prior art.

Similarly, FIG. 10 illustrates a plan view of a rhombic shaped pressure plate 7A with a circumscribed diameter 19 and an inscribed diameter 21 as discussed above and referred to in FIG. 1B.

Based on the above mentioned result of research, the ink jet heads having a number of chambers located in the form of a matrix were actually fabricated. Now, embodiments of the ink jet head in accordance with the present invention will be described with reference to the drawings.

First Embodiment

Figure 2:
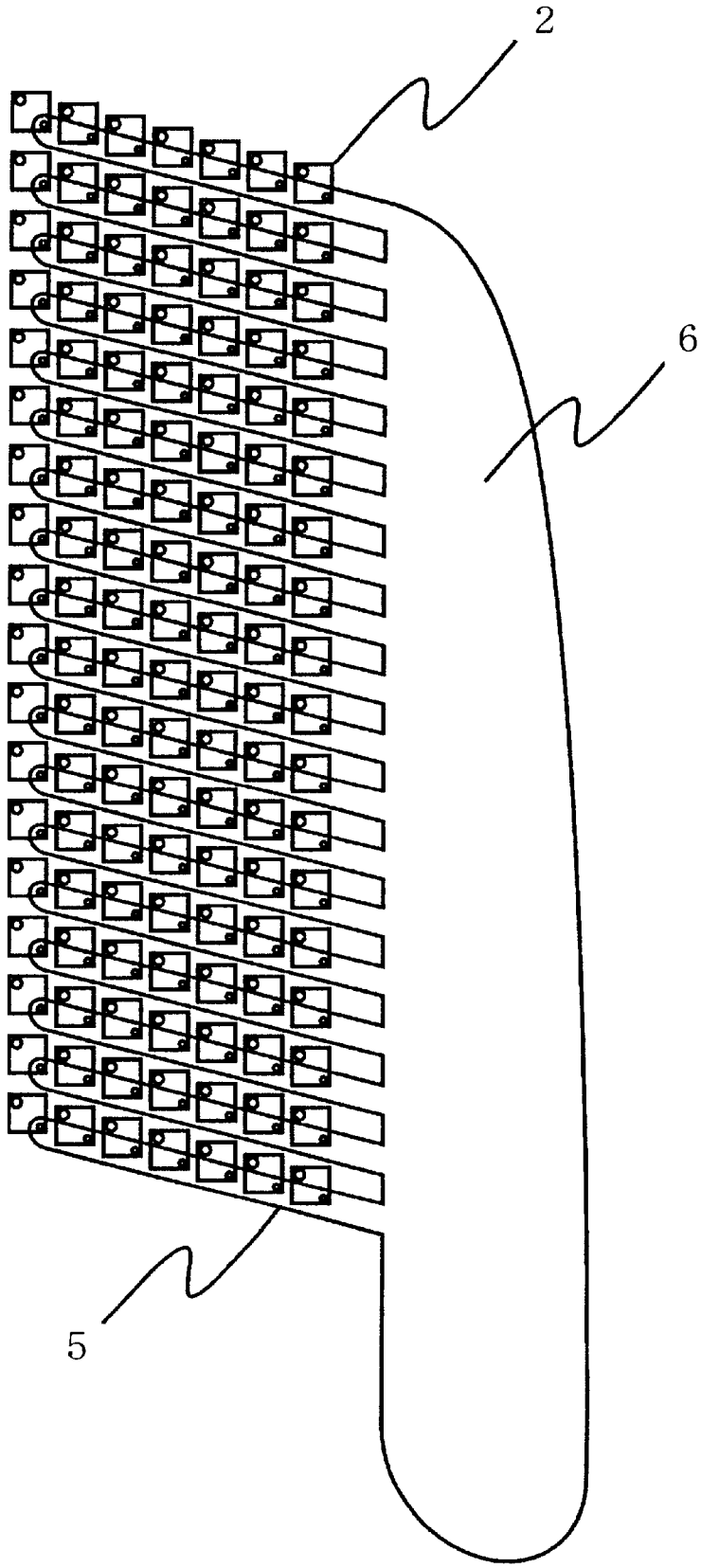
FIG. 2 is a diagrammatic layout pattern of a first embodiment of the ink jet head in accordance with the present invention.
Figure 4:
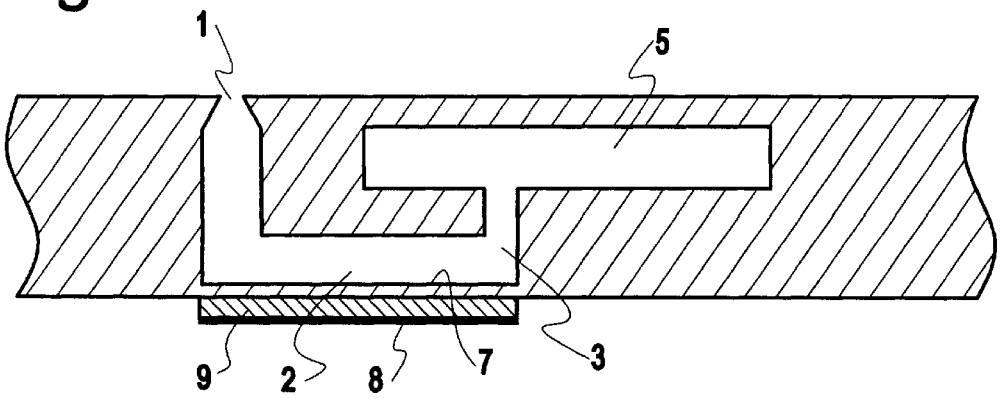
FIG. 4 is a diagrammatic partial sectional view of the first embodiment of the ink jet head in accordance with the present invention.

A first embodiments of the ink jet head in accordance with the present invention is characterized in that a number of chambers having the plan view shape of a substantial square and located in the form of a matrix and an ink pool for supplying an ink to respective chambers is of a comb shape having a main ink pool and a plurality of ink pool branches extending from the main ink pool as the teeth of the comb. FIG. 2 is a diagrammatic layout pattern of the whole of the first embodiment of the ink jet head in accordance with the present invention. FIG. 3 is a diagrammatic enlarged, partial layout pattern of the first embodiment of the ink jet head in accordance with the present invention, for stowing (he details. FIG. 4 is a diagrammatic partial sectional view of the first embodiment of the ink jet head in accordance with the present invention, for showing a sectional construction of the chamber.

The shown ink jet head includes a number of ink chamber units located in the form of a matrix. Each of the ink chamber units includes a nozzle 1 for discharging an ink drop, a chamber 2 having a plan view shape of a substantial square as shown in FIG. 3, provided for the corresponding nozzle 1, a pressure plate 7 forming a bottom plane of the chamber 2, and an actuator 9 bonded to the pressure plate 7 and having an individual electrode 8 for applying a drive voltage. A plurality of ink pool branches 5 are connected to a main ink pool 6 as the teeth of the comb. The chamber of each ink chamber unit is connected to a corresponding ink pool branch 5 through a supplying port 3 provided for each chamber.

Figure 5:
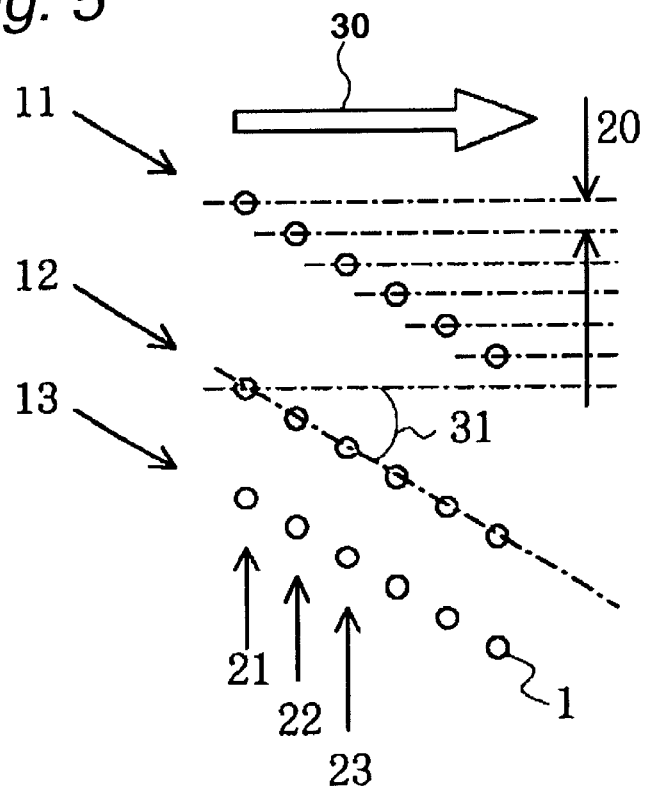
FIG. 5 illustrates necessary parameters for determining a matrix location of chambers in the first embodiment of the ink jet head in accordance with the present invention.

The matrix location of the chambers is determined by the following four parameters, as shown in FIG. 5. Namely, a first parameter is a pitch (called "d" hereinafter) of the nozzles (located in each row 11, 12, 13, . . . ) in a direction orthogonal to a head main scan direction 30. A second parameter is an angle 31 (called "θ" hereinafter) between each row 11, 12, 13, . . . and the head main scan direction 30 A third parameter is the number of nozzles located in each row 11, 12, 13, . . . (called "n" hereinafter). A fourth parameter is the total number of rows (called "m" hereinafter). In FIG. 5, each column 21, 22, 23, . . . is orthogonal to the head main scan direction 30.

The ink jet head was actually fabricated under the condition that "d"=0.1693 mm, "θ"=12.53 degrees, "n"=6, and "m"=16. In this layout, the total number of nozzles is 96, and the permissible maximum size of the plan view shape of each chamber 2 is that the head main scan direction width is 0.762 mm, and the width in the direction orthogonal to the head main scan direction is 1.016 mm. The actually formed chamber has a square plan view shape of 0.612 mm by 0.612 mm.

In this layout and this chamber size, a space between adjacent nozzles in the direction orthogonal to the head main scan direction is larger than that between adjacent nozzles in the head main scan direction. In this ink jet head, the space between adjacent nozzles in the direction orthogonal to the head main scan direction is positively utilized for a space for locating the ink pool branch 5. As a result, since the ink pool branch 5 can have as large width as possible, the ink pool can have a large capacity, so that it is possible to reduce a crosstalk between the nozzles occurring when the ink jet head is driven for discharging the drops, and also it is possible to elevate a refilling speed thereby to increase a driving frequency of the ink jet head. In this ink pool layout, the ink pool branches 5 are in parallel to the rows which are inclined at the angle "θ" to the direction orthogonal to the head main scan direction 30, and the number of the ink pool branches 5 is equal to the number "m" of the rows.

Each ink pool branch 5 is coupled at its base end to the main ink pool 6. In this connection, each ink pool branch 5 is branched from the main ink pool 6 in such a manner that the change of direction of the ink flow when the ink flow is branched from the main ink pool 6 to each ink pool branch 5 is smaller than 90 degrees. With this arrangement, when the ink flow is branched from the main ink pool 6, it is possible to prevent generation of eddies and dead water. Accordingly, the ink can be stably supplied to each chamber, so that reliability of the ink jet head can be elevated. In the shown embodiment, each ink pool branch 5 has a constant width from an upstream end to a downstream end (namely, from its base end to its tip end), and on the other hand, the main ink pool 6 has a width decreasing toward to a downstream end.

In the shown embodiment of the ink jet head, dummy chambers, which are not actually driven, are formed in a column positioned at the downstream end (namely, the tip end) of each ink pool branch 5 and in two rows positioned at the upstream end (base end) and at the downstream end (tip end) of the main ink pool. The dummy chambers have the same construction as the chambers which are actually driven. Actually, therefore, the number of the ink pool branches is "m+2". Provision of the dummy chambers makes it easy to expel an immixed bubble, so that the reliability of the ink jet head can be elevated.

The actuator 9 provided to each chamber 2 has the same outer size as that of the pressure plate 7 of the chamber 2, and has a thickness of 30 μm. The actuator 9 is bonded to the pressure plate 7 by a conductive bonding agent. The individual electrode 8 for applying the drive voltage is provided at the surface of the actuator 9 opposite to the pressure plate 7. The pressure plate 7 has a function as a common electrode.

In this embodiment, the actuator 9 is formed of a lead zirconate titanate type ceramics, but can be formed of other conventional ferroelectric material.

Now, a process for fabricating the above mentioned ink jet head will be described with reference to the drawings.

Figure 6:
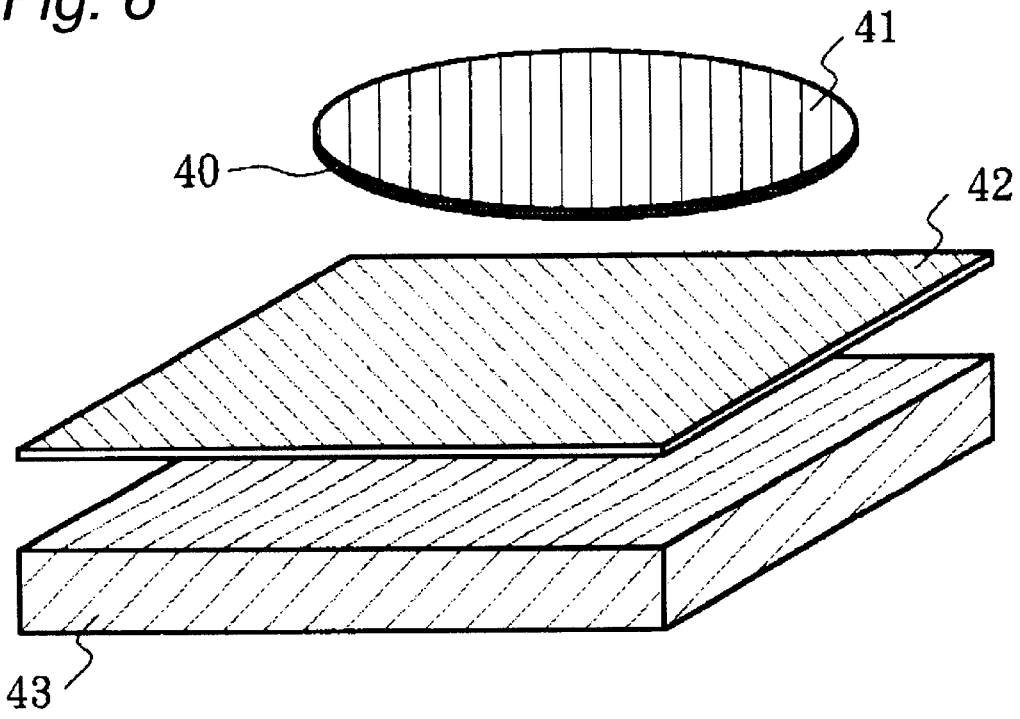
FIG. 6 is a diagrammatic exploded view illustrating a process for forming the actuators in the first embodiment of the ink jet head in accordance with the present invention.

Referring to FIG. 6, there is shown a diagrammatic exploded view illustrating a process for forming the actuators in the first embodiment of the ink jet head in accordance with the present invention. As shown in FIG. 6, a piezoelectric material sheet 40 having a thickness of 30 μm and opposite surfaces coated with an evaporated Au electrode 41, is affixed to a temporary fixing plate 43 by means of a temporary fixing adhesive sheet 42.

Figure 7A:
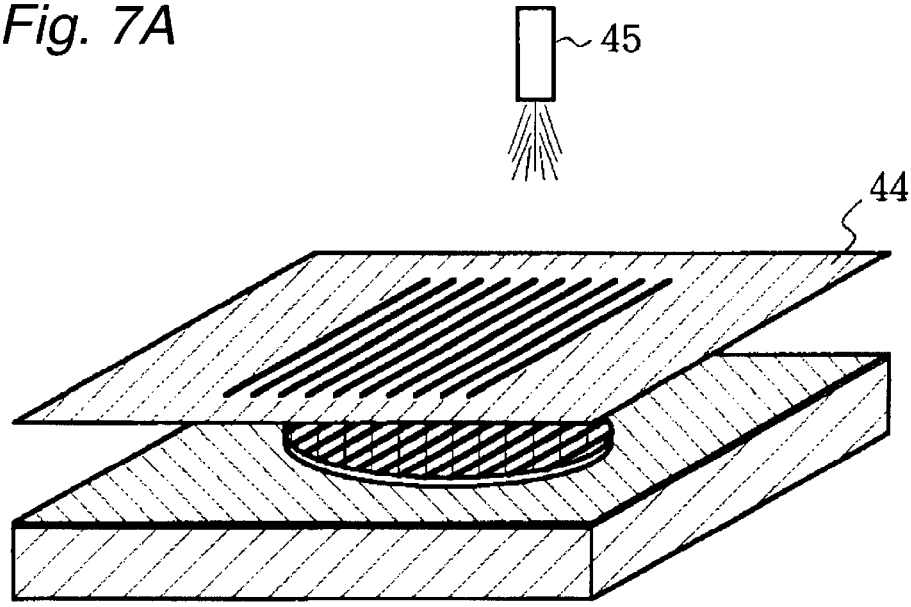
FIGS. 7A, 7B and 7C are diagrammatic exploded views illustrating a process succeeding to the process shown in FIG. 6, for forming the actuators in the first embodiment of the ink jet bead in accordance with the present invention.
Figure 7B:
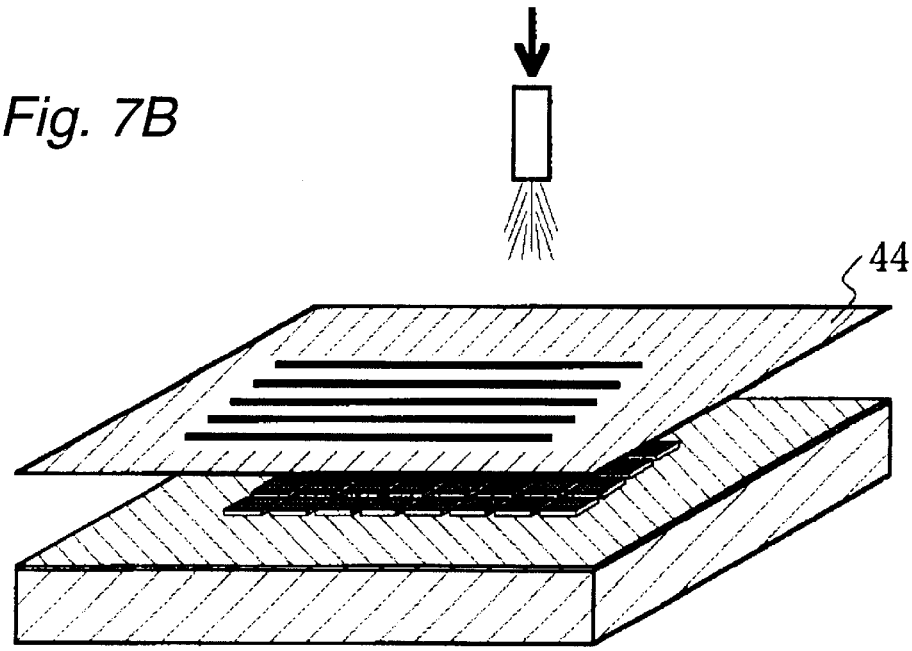
Figure 7C:
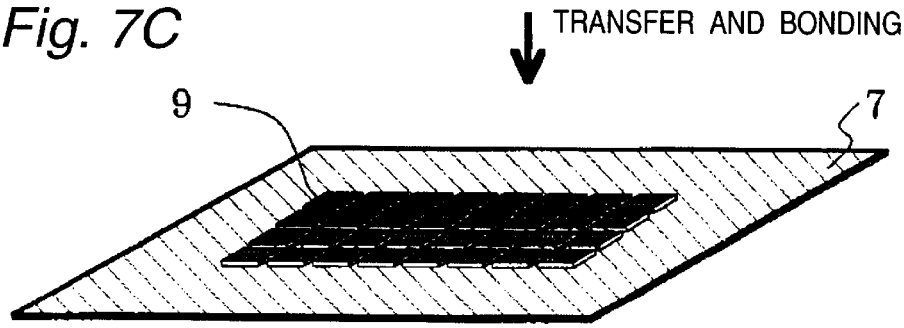

Thereafter, as shown in FIGS. 7A and 7B, a sandblasting is carried out by using a set of masks 44 which were prepared to meet the required position and the required size of the actuators, so that the piezoelectric material sheet 40 are divided into a number of separated actuators. Then, a conductive bonding agent (not shown) is coated on a surf ice of the separated actuators thus prepared, and transferred and bon ed to the pressure plate 7 having a thickness of 1 μm, and thereafter, the temporary fixing adhesive sheet 42 and the temporary fixing p ate 43 are removed. Thus, the pressure plate 7 having a number of separated actuators is completed, as shown in FIG. 7C.

Figure 8:
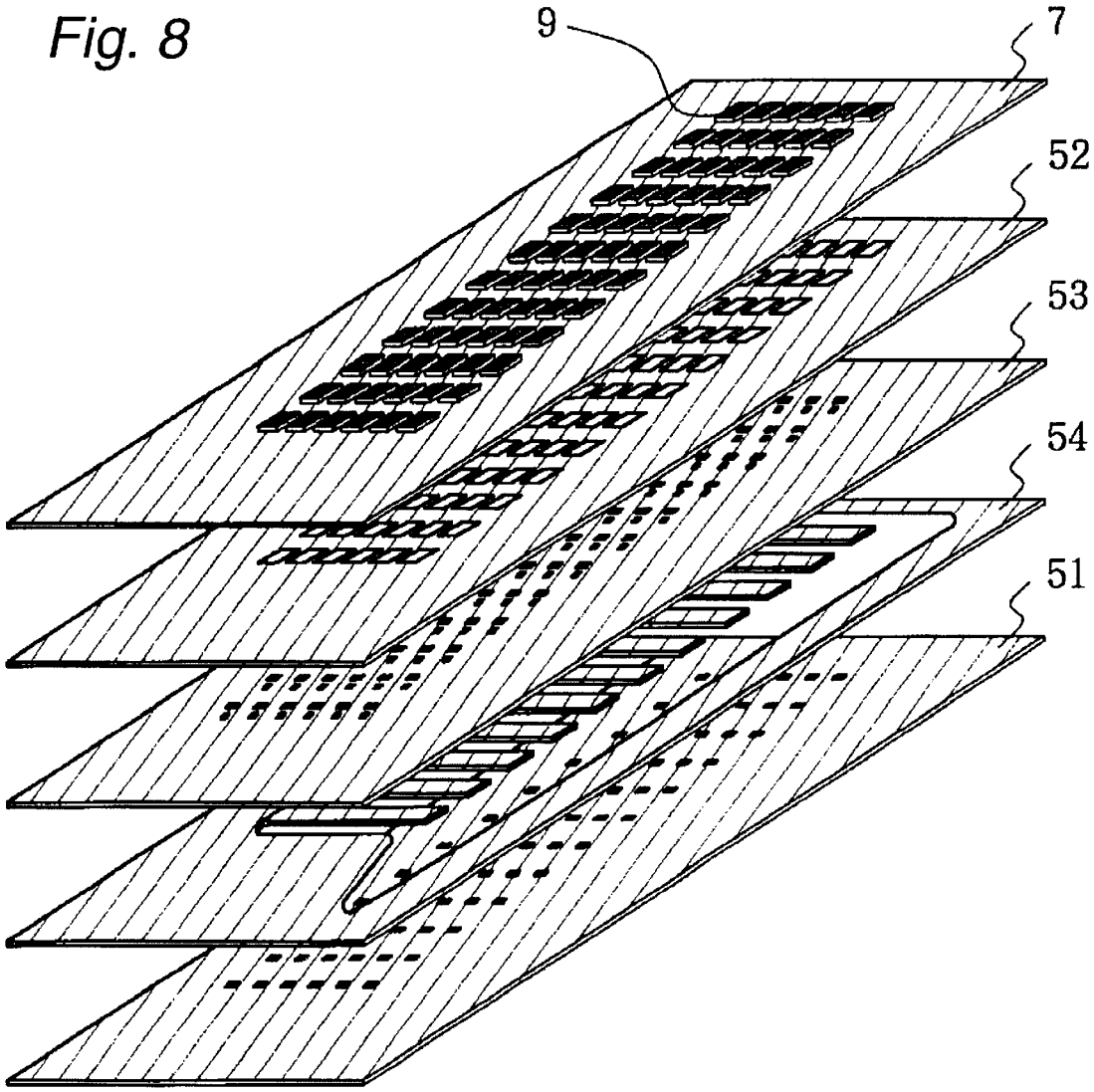
FIG. 8 is a diagrammatic exploded view illustrating a process succeeding to the process shown in FIG. 7C, for forming the first embodiment of the ink jet head in accordance with the present invention.

Next, a process for assembling the ink chamber units each including the nozzle 1 and the chamber 2 and all coupled to the ink pool in the form of a comb, will be described with reference to FIG. 8, which is a diagrammatic exploded view showing various members constituting ink chamber units, for illustrating a process for forming the first embodiment of the ink jet head in accordance with the present invention. Those members include a nozzle plate 51 having a number of nozzles, and a pool plate 54 having the main ink pool 6 and the ink pool branches 5 located in the form of a comb and a number of holes communicating with the nozzles, a supplying port plate 53 having a number of supplying ports and a number of holes communicating with the nozzles, a chamber plate 52 having a number of chambers, and the pressure plate 7. All of these plates are formed of a stainless steel sheet. The nozzles and the supplying ports 3 are formed by a punching press machine. The main ink pool 6 and the ink pool branches 5 located in the form of a comb, and the chamber 2, are formed by an etching. These ink chamber unit members (51, 52, 53 and 54) excluding the pressure plate 7 are bonded each other by an adhesive agent, and thereafter, the pressure plate 7 bonded with a number of separated actuators 9 is bonded to the bonded plates 51, 52, 53 and 54 by an adhesive agent.

Furthermore, an electrical connection is made for sup lying the drive voltage to the individual electrodes 8 provided for the respective actuator 9. In this embodiment, electrical terminals of a flexible printed cable (not shown) is located at a periphery of the ink chamber unit matrix, and the electrical terminals are connected to the individual electrodes 8 by a wire bonding. Thereafter, a polarization is carried out by applying a biasing voltage, so that the piezoelectric proper y is given to the actuator 9.

Now, an operation of the first embodiment will be described, An ink is supplied by connecting an ink supply tube (not shown) to the base end of the main ink pool 6, so that the ink is charged into th main ink pool 6, the ink pool branches 4, the supplying ports 3, the chambers 2 and the nozzles 1 in the named order.

Figure 9:
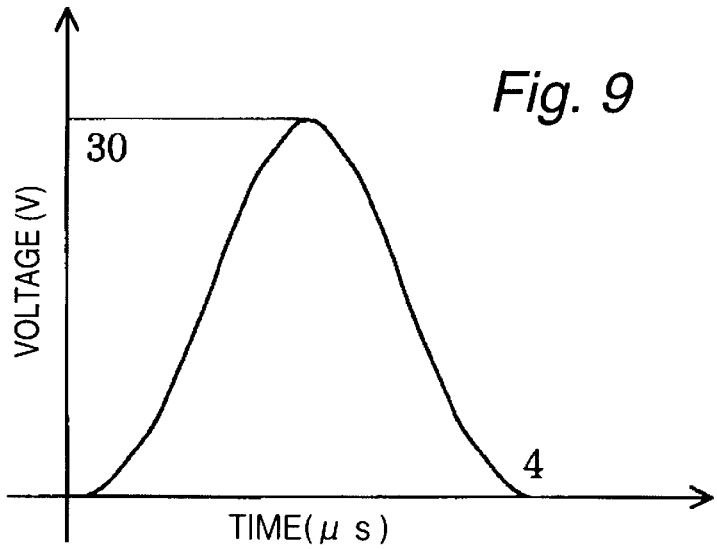
FIG. 9 is a waveform diagram illustrating a drive voltage for the first embodiment of the ink jet head in accordance with the present invention.

If a voltage having the waveform as shown in FIG. 9 is applied between the common electrode (pressure plate 7) and the individual electrode 8 of each actuator 9, the pressure plate is flexed by bimorph effect so that the ink within the chamber is compressed to discharge an ink drop through the nozzle 1.

It was confirmed that when the waveform as shown in FIG. 9 was applied to the actually fabricated ink jet head of the first embodiment, the ink drop of 30 picoliters was stably discharged from all the nozzles. In addition, it was also confirmed that when the similar test was carried out while changing the number of nozzles simultaneously driven, the ink drop of the same volume was stably discharged from all the nozzles driven. Furthermore, it was confirmed that a similar discharge characteristics was obtained although the position of the nozzles driven was changed.

From the result of the test, it was confirmed that by combining the substantially square chambers and the comb-shaped ink pool, the nozzles can be located with a high density and the ink jet can be stably discharged.

When the ink pool in the form of the comb is used, the flow amount of the ink flowing through the main ink pool becomes small toward the downstream end. Therefore, if the width of the main ink pool becomes small toward the downstream end as in this embodiment, the flow velocity of the ink is prevented from dropping at the downstream side, so that it is possible to prevent a bubble and a dirt from staying, thereby to elevate reliability of the ink jet.

In this embodiment, the pressure plate has the thickness of 15 $\mu$m. In this connection, it was confirmed by experiment that if th, pressure plate having the thickness of 2 $\mu$m is used, even if the size of th chamber is reduced to 0.2 mm by 0.2 $\mu$mm, the ink drop of 30 picoliters was discharged from the nozzles.

Therefore, in connection of the nozzle location, if the condition of $0<\tan\theta\leqq 5d$ (mm) and $n\times d\geqq 0.2$ is fulfilled, the chambers can be laid out so that the nozzles are located with a high density.

Second Embodiment

This second embodiment is characterized in that the plan view shape of each chamber assumes a substantial rhombus having a pair if sides in parallel to the rows and another pair of sides in parallel to the columns, so that the high efficiency of the square chamber is maintained and on the other hand the flow of ink within the chamber is smoothed to prevent the staying of a bubble so as to elevate the reliability of the ink jet head, and furthermore, the process for fabricating the ink jet head can be simplified.

Now, the second embodiment will be described with reference to FIG. 10, which is a diagrammatic enlarged, partial layout pattern of a second embodiment of the ink jet head in accordance with the present invention, for showing the details.

As shown in FIG. 10, the plan view shape of each chamber 2 has a substantial rhombus having a pair of sides in parallel to the rows (11, 12, 13, . . . in FIG. 5) and another pair of sides in parallel to the columns (21, 22, 23, . . . in FIG. 5). Namely, the pair of sides of the rhombus in parallel to the rows are inclined at the angle "θ" to the direction orthogonal to the head main scan direction 30. In addition, the nozzle 1 and the supplying port 3 are located at opposite ends of a longer diagonal line of the rhombus. The actuator 9 has the same plan view shape as the plan view shape of the rhombus chamber. Namely, the actuator 9 has the shape of a substantial rhombus having a pair of sides in parallel to the rows (11, 12, 13, . . . in FIG. 5) and another pair of sides in parallel to the columns (21, 22, 23, . . . in FIG. 5).

The construction other than the above mentioned features is the same as the first embodiment, and therefore, a further description of the construction will be omitted.

Next, a process for fabricating the second embodiment of the ink jet head will be described. The process for fabricating the second embodiment is different from the process for fabricating the first embodiment, only in a process for dividing the piezoelectric material sheet into the discrete actuators. Therefore, only this point will be described.

Similarly to the first embodiment, a piezoelectric material sheet 40 having a thickness of 30 $\mu$m and opposite surfaces coated with an evaporated Au electrode 41, is affixed to a temporary fixing plate 43 by means of a temporary fixing adhesive sheet 42. Thereafter, the piezoelectric material sheet 40 is divided into discrete actuators by a dicing which is simple, highly precise and high stable in comparison with the sandblasting. Since the sides of the discrete actuators a re aligned along a single straight line in parallel to the rows or the columns, the piezoelectric material sheet 40 can be divided in bundle in unit of a row or a column by the dicing. Therefore, the mask require for the sandblasting is no longer necessary, and accordingly, a process for the mask alignment can be omitted. As a result, the size and the position of the actuators can be patterned with a high precision.

In an operation of the second embodiment, the second embodiment is different from the first embodiment in that the flow of ink within the chamber is smoothed. Namely, since the ink flows along the longer diagonal line of the rhombus, the corner through which the ink flows becomes an obtuse angle, so that the flow becomes difficult to stay, and generation of bubble is prevented. As a result, the reliability of the ink jet head can be elevated.

The ink jet head of this second embodiment was actually fabricated, and the test similar to that executed for the first embodiment ",as carried out. As a result, it was confirmed that, similarly to the first embodiment, the ink drop of 30 picoliters was stably discharged from all the nozzles. In addition, it was also confirmed that when the similar test was carried out while changing the number of nozzles simultaneously driven, the ink drop of the same volume was stably discharged from all the nozzles driven. Furthermore, it was confirmed that a similar discharge characteristics was obtained although the position of the nozzles driven was changed.

From the result of the test, it was confirmed that the substantial rhombus chambers have a high efficiency, comparable to that obtained in the substantial square chambers. It was also confirmed that the nozzles can be located with a high density by combining the substantially rhombus chambers and the comb-shaped ink pool, and the ink jet can be stably discharged. Furthermore, by using the actuators having a plan view shape similar to the plan view shape of the substantial rhombus chambers, the fabricating process can be simplified, and the working precision can be elevated.

As mentioned above, in the ink jet head in accordance with the present invention, since the chambers have the chamber shape parameter "A" fulfilling the relation of $1\leqq A\leqq 2$, it is possible to obtain a high efficient chamber capable of realizing a necessary amount of volume change when it is driven, with a small plan view occupying area of the chamber. Therefore, the nozzles can be located with a hi h density without lowering the volume of the discharged ink drop.

In addition, when the chambers having the chamber shape parameter "A" fulfilling the relation of $1\leqq A\leqq 2$ have the plan view shape of a substantial rhombus, if the direction of the ink flow within the chamber is along the longer diagonal line of the rhombus, the corner through which the ink flows becomes an obtuse angle, so that the flow becomes difficult to stay, and generation of bubble is prevented. As a result, the reliability of the ink jet head can be elevated.

Furthermore, when the chambers are located to fulfill the condition of $0<\tan\theta\leqq 5d$ (mm), the condition of $n\times d\geqq 0.2$, or the condition of $0.5\leqq n\times\tan\theta\leqq 2$, the chambers having the chamber shape parameter "A" fulfilling the relation of $1\leqq A\leqq 2$ can be located in the form of a matrix with no substantial waste space. Therefore, the chambers having a small plan view occupying area can be laid out with a high efficiency. In addition, since the layout including the ink pool branches can be realized with a high density.

Moreover, if the main ink pool is formed to have the cross-sectional area larger than that of each ink pool branch, a stable ink flow can be obtained, and an ink supplying amount per unit time can be enlarged so that the discharge frequency can be increased. In addition, the variation in discharge characteristics between the nozzles be suppressed.

Furthermore, if it is so constructed that the main ink pool and/or each ink pool branch has the cross-sectional area gradually decreasing toward the downstream end, the ink can be stably supplied to a downstream portion of the ink stream, and the variation in discharge characteristics between the nozzles can be suppressed. In addition, it is possible to prevent the staying of a bubble which would have been caused by the lowering of the flow velocity, and therefore, the reliability of the ink jet head can be elevated.

As mentioned above, the present invention is very advantageous in elevating the nozzle density and the reliability of the ink jet head, in reducing the variation in discharge characteristics of the ink jet head, in simplifying the fabrication process of the ink jet head, and in elevating the fabrication precision. Therefore, the present invention has a very large industrial value.

The invention has thus been shown and described with reference to the specific embodiments. However, it should be noted that the present invention is in no way limited to the details of the illustrated structures but changes and modifications may be made within the scope of the appended claims.

What is claimed is:

1. An ink jet head comprising:

a plurality of nozzles arranged to form a matrix having a plurality of rows inclined at a constant angle to a head main scan direction and a plurality of columns orthogonal to said head main scan direction;

a plurality of chambers provided for said plurality of nozzles, respectively;

a pressure plate formed to constitute one plane of each of said plurality of chambers;

an actuator provided to each pressure plate, for deforming said pressure plate to compress an ink within a corresponding chamber;

a plurality of ink pool branches provided along said plurality of rows or said plurality of columns, for supplying said ink to said plurality of chambers; and a main ink pool connected to said plurality of ink pool branches, wherein said pressure plate has a plan view shape fulfilling the relation of $1\leqq A\leqq 2$ where "A" is the ratio of a circumscribed circle diameter of the plan view shape of said pressure plate to an inscribed circle diameter of the plan view shape of said pressure plate.

2. An ink jet head claimed in claim 1 wherein said pressure plate has the plan view shape of a substantial square.

3. An ink jet head claimed in claim 2 wherein when the inclination of each row to said head main scan direction is expressed by "θ" and the interval of said plurality of nozzles in a direction orthogonal to said head main scan direction is expressed by "d" (mm), "θ" and "d" have the relation of $0\leqq\tan\theta\leqq 5d$.

4. An ink jet head claimed in claim 3 wherein when the number of said nozzles included in each row is expressed by "n", "n" and "d" have the relation of $n\times d\geqq 0.2$.

5. An ink jet head claimed in claim 4 wherein "n" and "θ" have the relation of $0.5\leqq n\times\tan\theta\leqq 2$.

6. An ink jet bead claimed in claim 5 wherein said main ink pool has the cross-sectional area larger than the cross-sectional area of said ink pool branch.

7. An ink jet head claimed in claim 6 wherein at least one of said main ink pool and said each ink pool branch has the cross-sectional area gradually decreasing toward the downstream end.

8. An ink jet head claimed in claim 1 wherein said pressure plate has the plan view shape of a substantial rhombus having a pair of sides in parallel to said plurality of rows and another pair of sides in parallel to said plurality of columns.

9. An ink jet head claimed in claim 8 wherein said actuator has a plan view shape of a substantial rhombus having a pair of sides in parallel to said plurality of rows and another pair of sides in parallel to said plurality

10. An ink jet head claimed in claim 9 wherein each of said plurality of chambers has an ink supply port to form an ink flow in the direction of a long diagonal of said substantial rhombus.

11. An ink jet head claimed in claim 10 wherein when the inclination of each row to said head main scan direction is expressed by q; i" and the interval of said plurality of nozzles in a direction orthogonal to said head main scan direction is expressed by "d" (mm), "O" and "d" have the relation of $0\leqq\tan\theta\leqq 5d$.

12. An ink jet head claimed in claim 11 wherein when the number of said nozzles included in each row is expressed by "n", "n" and "d" have the relation of n×d 0.2.

13. An ink jet head claimed in claim 12 wherein "n" and "θ" have the relation of $0.5\leqq n\times\tan\theta\leqq 2$.

14. An ink jet head claimed in claim 13 wherein said main ink pool has the cross-sectional area larger than the cross-sectional area of said ink pool branch.

15. An ink jet head claimed in claim 14 wherein at least o we of said main ink pool and said each ink pool branch has the cross-sectional area gradually decreasing toward the downstream end.

16. An ink jet head claimed in claim 8 wherein when the inclination of each row to said head main scan direction is expressed by "E" and the interval of said plurality of nozzles in a direction orthogonal to said head main scan direction is expressed by "d" (mm), "θ" and "d" have the relation of $0\leqq\tan\theta\leqq 5d$.

17. An ink jet head claimed in claim 16 wherein when the lumber of said nozzles included in each row is expressed by "n", "n" and "d" have the relation of $n\times d\geqq 0.2$.

18. An ink jet head claimed in claim 17 wherein "n" and "θ" have the relation of $0.5\leqq n\times\tan\theta\leqq 2$.

19. An ink jet head claimed in claim 18 wherein said main ink pool has the cross-sectional area larger than the cross-sectional area of said ink pool branch.

20. An ink jet head claimed in claim 19 wherein at least one of said main ink pool and said each ink pool branch has the cross-sectional area gradually decreasing toward the downstream end.

* * * * *